US006003250A

United States Patent [19]

Cheong

[11] Patent Number: 6,003,250

[45] Date of Patent: Dec. 21, 1999

[54] FOOT SUPPORT

[76] Inventor: Wilson Cheong, 69 Chetwynd Street, North Melbourne, Victoria, 3051, Australia

[21] Appl. No.: 09/008,371

[22] Filed: Jan. 16, 1998

[30] Foreign Application Priority Data

Jan. 17, 1997 [AU] Australia ..... PO4644

[51] Int. Cl.[6] ..... A43B 7/14; A61F 5/14

[52] U.S. Cl. ..... 36/153; 36/165

[58] Field of Search ..... 36/153, 154, 29, 36/165, 164

[56] References Cited

U.S. PATENT DOCUMENTS

| | | | |
|---|---|---|---|
| 1,477,146 | 12/1923 | Marteau et al. . | |
| 2,096,563 | 10/1937 | Scholl . | |
| 2,645,865 | 7/1953 | Town . | |
| 2,762,134 | 9/1956 | Town . | |
| 2,917,844 | 12/1959 | Scholl . | |
| 3,777,419 | 12/1973 | Nalick | 36/71 |
| 4,115,934 | 9/1978 | Hall . | |
| 4,211,236 | 7/1980 | Krinsky . | |
| 4,229,889 | 10/1980 | Petrosky . | |
| 4,670,995 | 6/1987 | Huang . | |
| 4,821,431 | 4/1989 | Rieffel | 36/88 |
| 5,067,255 | 11/1991 | Hutcheson | 36/43 |
| 5,155,927 | 10/1992 | Bates et al. | 36/28 |
| 5,228,217 | 7/1993 | Dabuzhsky et al. | 36/28 |
| 5,493,792 | 2/1996 | Bates et al. | 36/28 |
| 5,686,167 | 11/1997 | Rudy . | |

FOREIGN PATENT DOCUMENTS

| | | |
|---|---|---|
| B-79483/82 | 7/1982 | Australia . |
| 78270/81 | 6/1983 | Australia . |
| B-45719/85 | 2/1986 | Australia . |
| 569571 | 5/1961 | Belgium . |
| 0664970 A1 | 8/1995 | European Pat. Off. . |
| 2133082 | 11/1972 | France . |

*Primary Examiner*—Ted Kavanaugh
*Attorney, Agent, or Firm*—Wolf, Greenfield & Sacks, P.C.

[57] ABSTRACT

Foot support for insertion into a shoe, which readily adjusts to the form of a foot without the need for qualified fitting and which can be adjusted by the person using the support. The foot support includes a flexible top layer, a base layer, and a sidewall connected to edge regions of said top and base layers. Said foot support further includes a cavity defined between said top and base layers, which extend about a forward pocket of said support and which contains a flowable gel, the flowable gel facilitating the adaption of the flexible top layer to the sole of a foot for support thereof. The forward pocket is located in the region to support the transverse arch of a foot and is able to receive a support medium to facilitate adjustable support of the transverse arch.

31 Claims, 2 Drawing Sheets

FOOT SUPPORT

FIELD OF THE INVENTION

The present invention relates to a foot support which can be inserted into a shoe.

BACKGROUND OF THE INVENTION

Foot supports, sometimes known as foot-beds or insoles, are known to have various configurations which are designed for different needs. Foot supports can be used to lessen or eliminate foot abnormalities, such as excessive pronation or supination and to better support the feet during certain activities such as sports activities, for example skiing, running, bushwalking, tennis, football etc. Some foot supports are of a very simple construction and are used simply to provide enhanced cushioning for the sole of a foot rather than actual support. Such foot supports can be made of any suitable cushioning material, such as foams or rubbers.

Other foot supports are known to provide more than simply a cushioning effect, and such supports are intended to actually support the skeletal and/or muscular structure of certain parts of the foot. Supports of this kind can be moulded into a desired shape by suitable mouldable materials, such as foams, plastics and rubbers, once the characteristics of the required support have been determined. The shape of the moulded support may provide foot support in various forms, such as for the various arches of the foot, for the heel, or for the sides of the foot. Also, such foot supports may compensate for variations between a pair of feet or legs, such as for small differences in feet or leg size or length.

Foot supports can be manufactured on a mass production basis in shapes that are designed to compensate for very common problems which occur because of inadequate foot support. Such foot supports are successfully used by the proportion of the population that has otherwise "normal" feet, but who commence a particular activity that throws an abnormal strain on the feet. Skiing is one such activity in which persons having otherwise healthy and normal feet, can in general, successfully adopt "off-the-shelf" foot supports. These supports however, often lack the specific support needed by persons having more complicated support requirements.

Some more customised foot supports can be moulded about the foot, or from an impression taken from the foot, so as to accurately trace the contours of the foot. That moulded surface may then be applied to a base which positions the support correctly within the shoe and orientates the moulded surface so that the desired foot support is properly located.

One disadvantage with foot supports in general, is that the cheaper supports which can be purchased off-the-shelf, such as in supermarkets or pharmacies, typically provide little more than cushioning or impact absorption, while the more expensive supports which actually provide a supporting function, normally need to be fitted by a specialist, thus requiring the inconvenience of an appointment for fitting.

It is an object of the present invention to provide a foot support which has a supporting function rather than just a cushioning function. It is a further preferred object of the invention that a foot support be provided which readily adjusts to the form of a foot without the need for qualified fitting and which can be adjusted by the person using the support.

SUMMARY OF THE INVENTION

According to the present invention there is provided a foot support for insertion into a shoe, said foot support including a flexible top layer, a base layer, and a side wall connected to edge regions of said top and base layers, said foot support further including a cavity defined between said top and base layers, which extends about a forward pocket of said support and which contains a flowable gel, said flowable gel facilitating the adaptation of said flexible top layer to the sole of a foot for support thereof, said forward pocket being located in a region to support the transverse arch of a foot and being able to receive support medium to facilitate adjustable support of said transverse arch.

The foot support of the invention, by incorporating a cavity filled with flowable gel, can adapt to the sole of a foot, by movement of the flowable gel within the cavity. Preferably, the volume of gel within the cavity is adjustable, although adjustment of the foot support can alternatively or additionally be achieved by the application of an adjustment plate or plates to the underside of the side wall and base layer. The plate may serve to adjust the height and shape of the foot support. The side wall may also be adjustable by the addition or removal of a portion thereof.

Maximum adaption or customization of the foot support can be dependent on the correct volume of gel being present within the cavity and the correct volume is dependent on certain factors, for example the type of shoe, the particular activity, and personal preference. The volume need not necessarily be the maximum available for the cavity, but instead may be an amount of an order less than the maximum value, depending on the characteristics required. Moreover, the flowable nature of the gel enables the supporting characteristics of the support to adapt to changing conditions under which the support may be placed. That is, the support can continuously modify itself in order to support the foot of someone who might be walking in one instance and running in another. Likewise, the support can adapt itself under different loading, as for example may be experienced by a person who carries heavy articles during a portion of his or her day, or for a person who may for example, during loading of trucks or containers, jump on and off the loading surface. The support can also adapt itself to the unique action of an individual as that individual performs various activities such as those discussed above. Thus, the support advantageously can not only adjust to support feet in a manner which is generally required depending on the activity concerned, but it can also take into account the particular characteristics which differentiate one person's feet from another.

The foot support as described operates to continuously modify the shape and support given by the top layer, to support the triplanar movements of the feet and ankles, those triplanar movements occurring in relation to the frontal, transverse and sagittal planes, i.e. movements in relation to pronation and supination. The adjustable nature of the flowable gel held within the cavity, combined with the available adjustment of support medium in the forward pocket, enable the foot support to provide adequate support to the feet of persons having minor to excessive pronation or supination.

The foot support of the invention is envisaged to have application in many fields additional to those described above such as in sports including tennis, golf, skiing and in-line skating. In these sports, as well as the other work related activities described earlier, the foot does not experience the same forces as it would under walking conditions, eg. heel strike, stance phase and push off. In these work and sporting activities, the foot will typically experience a greater amount of lateral forces, which, if the foot is not properly supported, can result in excessive pronation or supination development of the feet.

The foot support of the invention also benefits the user in circumstances in which the pressure patterns between the left and right feet differ. Feet pressure patterns are generally not identical between left and right feet, but normally the differences between those patterns are not sufficient to result in a need for treatment. However, in a small percentage of the population, those differences do result in trauma for the person involved and foot support is required. The foot support of the present invention can be used to treat such patients.

In a similar manner, slight differences in leg lengths can be accommodated by differing the volume of gel received within the cavity of the supports for respective left and right feet. That is, the greater volume of gel can be employed in the support for the shorter leg.

The adjustable nature of the foot support has benefits also for ongoing changes in feet and legs, such as during a child's growth, changing weight, changes in foot shape and changing muscle bulk. In each instance, the supporting characteristics necessary for the feet may change, requiring modification to the foot support used. In supports which have no adjustable function, new supports may be required at additional expense and inconvenience to the person involved, however the foot support of the invention can be adjusted by altering the volume or type of flowable gel held within the cavity and the support medium located in the forward pocket.

The construction of the foot support can take various forms. The top layer is required to have a sufficient degree of flexibility so that pressure applied to the top layer is transferred to the flowable gel, which flows as necessary so that the top layer adjusts to the foot sole. The top layer for example, can be constructed from ethyl vinyl acetate (EVA) foam of medium density and 2 to 3 mm thickness.

Likewise, the base can also be constructed of EVA foam as used for the top layer, although the base layer does not necessarily have the requirement for flexibility and therefore other non-flexible materials can be adopted.

Preferably the side wall is resiliently flexible and extends on both sides of the support and about the rear of the heel. The side wall can for example be constructed from a higher density EVA foam than the top layer and can be in the order of 3 to 5 mm thick. A stiff leather could alternatively be used. Still alternatively, the side wall can be a composite construction, combining the characteristics of a plurality of materials.

The upper surface of the side wall is preferably constructed to shape approximately to one or more of the lateral and medial arches and the heel of the foot. The upper surface of the side wall is preferably inclined from an outer edge thereof to slope downwardly into connection with the edge of the top layer, or the top layer may overlie the inclined upper surface. The resiliently flexible nature of the side wall provides support, principally for the lateral and medial arches, but also in respect of the heel of the foot. Further, the shaping of the side wall also affects the disposition of the top layer, so that when the cavity which is formed between the top layer and the base layer is filled with flowable gel, the top layer forms support regions to support the various arches of the foot. The provision of a heel portion and a forward pocket assist with the generation of these arches.

The height of the side wall may also be adjustable by gluing strips of any suitable material to the base of the side wall. For example, one or more strips of EVA can be adhesively applied to the base of the side wall so as to raise its height. Conversely, the height of the side wall can be reduced by removing a layer of EVA foam from the side wall.

In an alternative embodiment, the side wall is positioned within a rigid casing, such as a fibreglass shell. The rigid casing serves to limit the flexibility of the side wall particularly from bulging and can provide a more stable support to the foot.

The connection of the top and base layers to the side wall may include both fixed and non-fixed connections. In one form, the top layer is fixed by an adhesive to the side wall and the junction between the side wall and top layer is substantially smooth or continuous. The edge of the top layer can for example engage the inner surface of the side wall in an abutting manner and be adhered thereto. Alternatively, the top layer can overlie the top surface so that an underneath surface of the top layer rests on the top edge of the side wall. Again, in this arrangement an adhesive can be used to fix the top layer to the side wall. This latter arrangement is preferred as pressure exerted on the top layer by a foot, tends to press the top layer into engagement with the side wall so that it does not lift away.

The base layer however need not be fixed to the side wall in the same manner as the top layer and in one arrangement, the base layer is tucked up against the inside surface of the side wall and when the support is inserted into the shoe and pressure brought to bear against the top layer, the pressure exerted on the flowable gel tends to force the tucked-up portion of the base layer against the inside surface of the side wall. In this arrangement, the tucked-up portion of the base layer is prevented from pulling away from the side wall, because the base layer sits against the internal sole of the shoe to which it is applied, and the application of pressure by a foot to the foot support firmly holds the base layer against that surface.

The foot support can include a heel portion and such a heel portion of the foot support is, as the name suggests, the portion of the support which is aligned with the heel of a foot when the support is in use. The cavity extends about the heel portion and preferably, the heel portion is fully surrounded by the cavity so that the heel is fully supported by the gel within the cavity. Preferably the cavity surrounding the heel portion is inclined upwardly away from that portion, so as to cup the heel of a foot.

The heel portion may have a limited support or cushioning characteristic and in fact the cavity surrounding the heel portion may provide the necessary support and cushioning required for the heel. In that circumstance, the heel portion may be devoid of any supporting characteristics and may simply be an open area into which the heel of a foot is located. More preferably however, the heel portion is defined in an area in which the top layer is connected to the base layer by any suitable means. The top layer may for example, be connected to the base layer by stitching or an adhesive and the connection may be a single continuous line forming a boundary within which the heel portion is defined, such that the top layer is fixed to the bottom layer only about that line. Alternatively, a plurality of fixing lines may be employed. Alternatively, the top layer may be fully adhered to the base layer across the full area of the heel portion. The heel portion is preferably round, oval or tear drop shaped.

The heel portion may in one arrangement have support or cushioning characteristics and may for example include a support medium such as an amount of an equivalent flowable gel such as that contained in the cavity. However, the nature of the heel portion is such that little, if any support is necessary in that region. The existence of the top and base layers lying adjacent one another with no intervening support medium has been found to be quite adequate.

The forward pocket preferably has an apex formed toward the heel portion and diverging from that apex away from the heel portion toward the front or leading edge of the foot support. The forward pocket is preferably open at the forward end in order to receive support medium for support of the transverse arch. The forward pocket is located in the region beneath the second, third and fourth metatarsals.

The forward pocket can be formed in a manner similar to that of the heel portion, by connecting the top and base layers in the configuration required. A single line of stitching or adhesive may be employed to form the forward pocket. The cavity may extend between the forward pocket and the heel portion and on either side of the forward pocket.

The support medium for the forward pocket can be in the form of the flowable gel located in the cavity, or can take other forms such as foam, paper, cardboard, plastic or rubber inserts. If the medium is a flowable gel, then it needs to be provided in a flexible package or pouch in order to prevent it flowing out of the pocket. The volume of the pocket can be adjusted by increasing or decreasing the amount of support medium contained therein, and the simple nature of the support medium, i.e. paper or cardboard sheets, can enable adjustments to be easily made, simply by inserting or removing the medium as necessary.

The flowable gel can be chosen on the basis of the required characteristics of the foot support. Preferably, however, the flowable gel has a highly viscous consistency like that of a deformable plastic material. With such a gel, changes in the shape of the foot support would be localised, so that a change in foot pressure which alters the shape of the foot support at one position does not cause an alteration at other positions. The flowable gel can be described as an elasto-plastic material having the above characteristics.

The limited flow characteristics of the preferred type of gel, facilitate the use of a base layer which is not fixedly connected to the side wall and which includes the earlier described tucked flap in abutting engagement with the side wall. In this arrangement, the addition or reduction of gel volume within the cavity is easily altered, by untucking the flap from the side wall and making the addition or reduction as required. Further, the limited flow characteristics of the preferred gel facilitates modification of particular areas of the foot support as the gel is not sufficiently flowable to transfer volume to other parts of the cavity upon exertion of pressure against the top layer.

DETAILED DESCRIPTION

The attached drawings show an example embodiment of the invention included in an assembly of the foregoing kind. The particularity of those drawings and the associated description does not supersede the generality of the preceding broad description of the invention.

Figure 1:
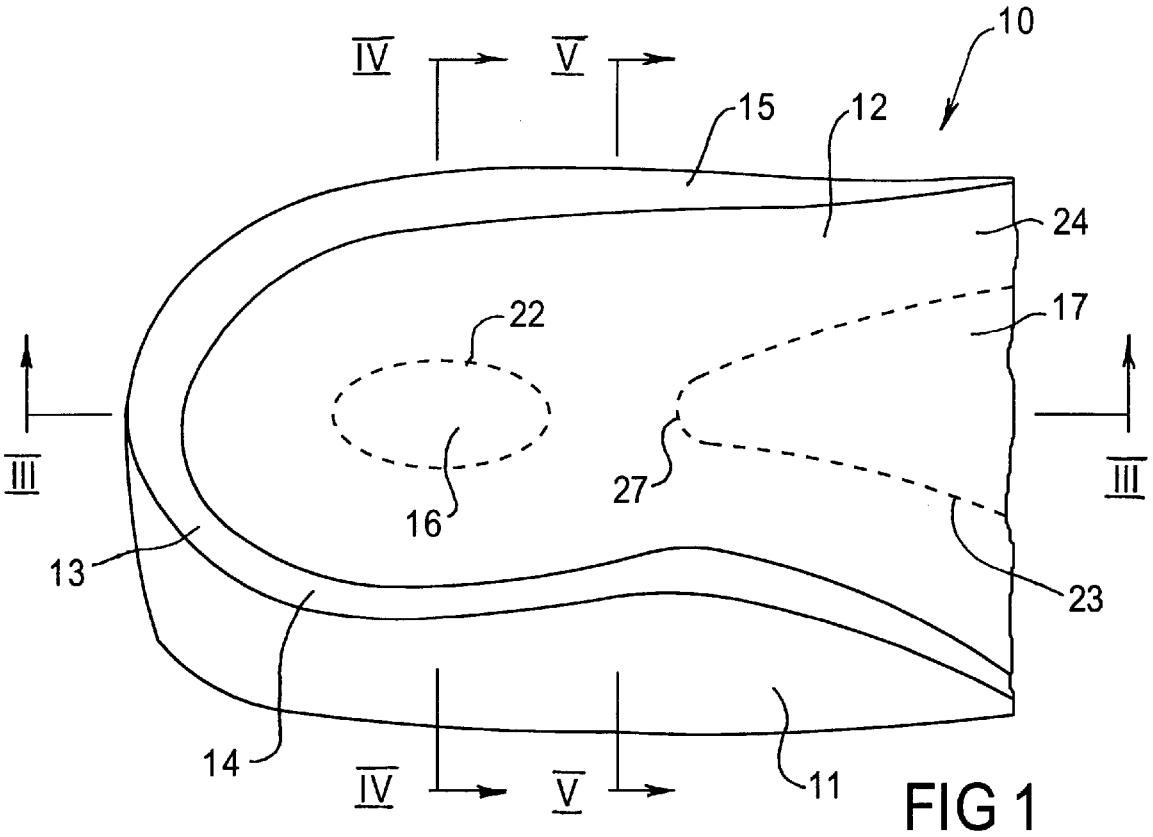
FIG. 1 is a front perspective view of a first embodiment of a foot support according to the present invention.
Figure 2:
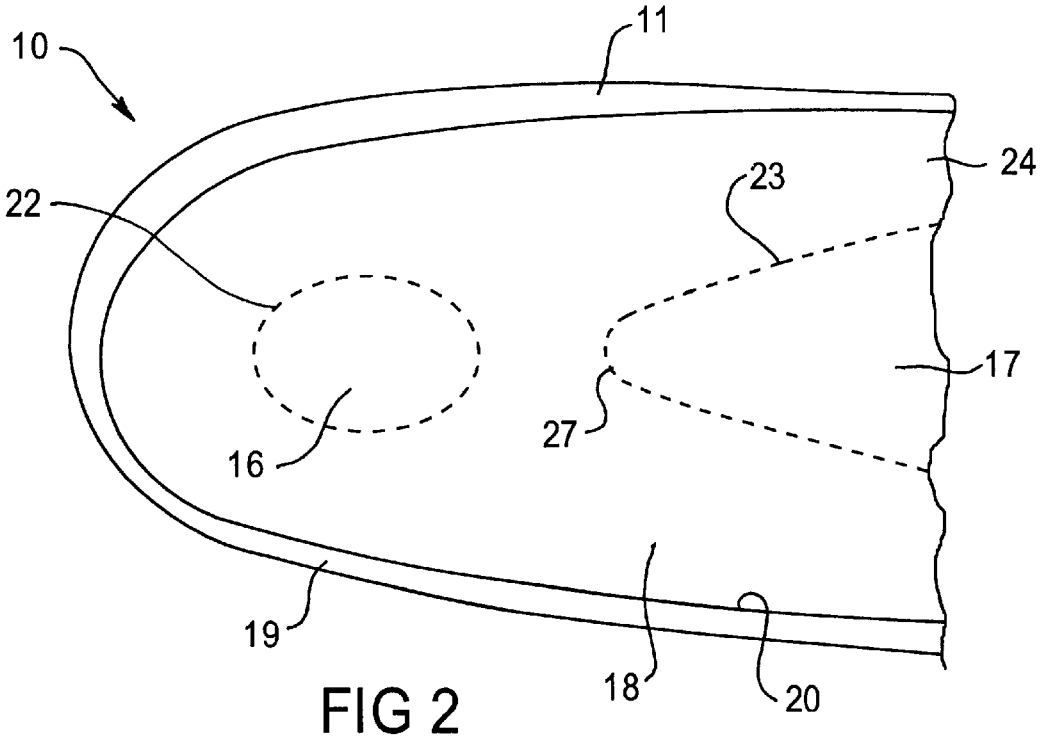
FIG. 2 is a bottom plan view showing a base layer beneath the foot support of FIG. 1.

Referring to FIGS. 1 and 2, a foot support 10 is illustrated having a side wall 11 and a top layer 12. The upper surface 13 of the side wall 11 is shaped to provide support for the medial and lateral arches. As can be seen from the drawings, the inner side 14 of the upper surface 13 curves upwardly to a greater extent than the outer side 15.

Connected to the side wall by any suitable means, such as by adhesive or other suitable fastener, is the top layer 12. The top layer 12 extends from a position adjacent the upper surface 13 of the side wall 11 and extends inwardly and downwardly toward a heel portion 16 toward the rear of the foot support 10, and a forward pocket 17 toward the front thereof. In FIGS. 1 and 2, heel portion 16 is shown as having an oval shape.

Beneath the foot support 10 as shown in FIG. 2, is a base layer 18. The base layer 18 extends between the bottom surface 19 of the side wall 11 and tucks up against the inner surface 20 of the side wall 11 so as to create a cavity between the side wall 11, the top layer 12 and the base layer 18.

Figure 3:
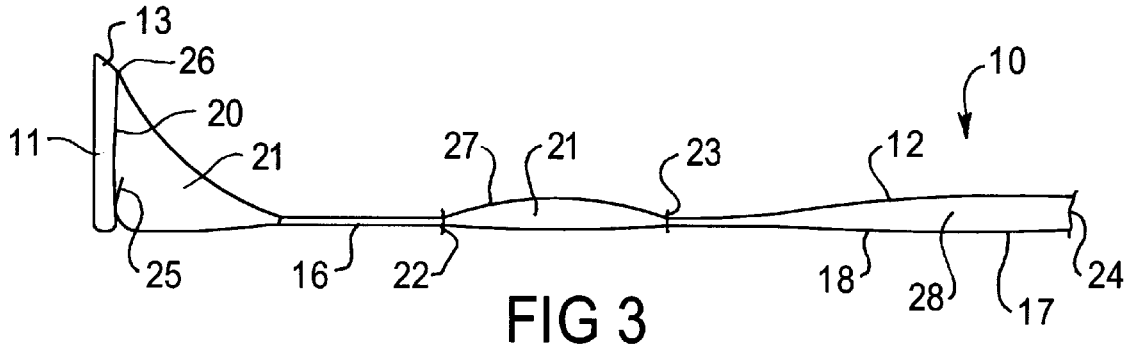
FIG. 3 is a sectional view taken along line 3—3 in FIG. 1.
Figure 4:
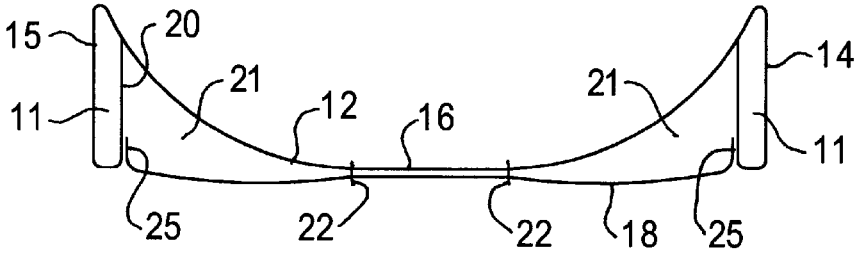
FIG. 4 is a sectional view taken along line 4—4 in FIG. 1.
Figure 5:
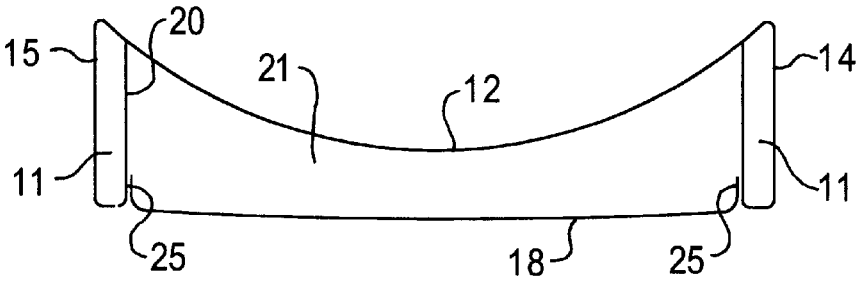
FIG. 5 is a sectional view taken along line 5—5 in FIG. 1.

The cavity 21 can be seen in cross-section in each of FIGS. 3 to 5. The cavity 21 receives a flowable gel which preferably has a limited viscosity and a limited propensity to flow, in order that the top layer 12 can adapt to the sole of a foot. The cavity 21 extends fully around the heel portion 16 and about the sides of the forward pocket 17, thereby creating a channel within which the gel can flow.

As can be seen in FIGS. 3 and 4, the heel portion 16 is separated from the cavity 21 by a connection of the top layer 12 to the base layer 18. That connection can be made by any suitable means such as by stitching, or by the use of a suitable adhesive. In the embodiment illustrated, a single stitch line 22 defines the heel portion.

The forward pocket 17 is also formed by a stitch line 23 which connects the top layer 12 to the base layer 18. However, the stitch line 23 is open ended towards the front end 24 of the foot support 10 in order that the pocket can receive support medium to support the transverse arch of a foot.

As is evident in FIGS. 3 to 5, the base layer 18 is connected to the side wall 11, simply by tucking up an edge portion 25 against the inner surface 20 of the side wall. This connection is sufficient in the embodiment illustrated as the flowable gel has limited viscosity and operates to push the edge portion 25 against the inner surface 20 of the side wall 11. This arrangement also has the advantage that the addition or removal of flowable gel from the cavity 21 can be made quickly and simply by removing the edge portion 25 from engagement with the inner surface 20 so as to provide access to the cavity 21, after which the volume of flowable gel can be increased or decreased. Once the alteration has been made, the edge portion 25 can simply be reinserted into the cavity against the inner surface 20.

A flowable gel of limited viscosity has the advantage that it is substantially restricted to localised movement within the cavity 21. That is, the gel will not tend to flow continuously about the cavity 21, but instead will adapt to pressure changes exerted by the sole of a foot in the immediate vicinity of those changes. Advantageously, addition or removal of flowable gel can be made in specific areas to alter the characteristic of the foot support in those areas.

The flowable gel preferably also has adhesive qualities, to adhere to the top layer, base layer and side wall respectively. Such an adhesive gel retains its flowable characteristics, but tends to resist sliding movement between the top and base layers, the side wall and the flowable gel.

FIG. 3 is a longitudinal cross-section through III—III of FIG. 1 while FIGS. 4 and 5 are lateral cross-sections through IV—IV and V—V of FIG. 1. Referring to FIG. 3, the top layer 12 is adhered at the junction 26 to the side wall 11 and extends in a downwardly inclined direction to the heel portion 16. At the heel portion 16, the top layer 12 is stitched to the base layer 18. There is no intervening material between the top and base layers in the heel portion. At the forward side of the heel portion, the top layer again diverges from the base layer creating a cavity 21 between the heel portion and the front pocket. At the rear end 27 of the forward pocket 17, the top layer is again stitched to the base layer. The top layer of the forward pocket also diverges from the base layer to provide a cavity which is fillable by a support medium generally identified by the reference numeral 28. The support medium 28 is removable from the forward pocket 17, so that the volume of support medium held within the forward pocket can be adjusted. The support medium 28 can comprise a pouch of flowable gel for example, or sheets of paper, cardboard, rubber or plastic or any other suitable medium.

Referring to FIG. 4, this figure shows the top layer 12 adhered to the side wall 11 at both sides and extending in a downwardly inclined direction to the heel portion 16. Between the top layer and the base layer on either side of the heel portion, the cavity 21 is defined.

In FIG. 5, it is apparent that the cavity extends fully across the foot support between each of the side walls 11. The cavity in this region provides arch support for the lateral arches.

FIG. 5 also illustrates a composite side wall, comprising separate sections 30–32 that have been assembled together. The material of these sections can be chosen to provide particular support characteristics.

The invention described herein is susceptible to variations, modifications and/or additions other than those specifically described and it is to be understood that the invention includes all such variations, modifications and/or additions which fall within the spirit and scope of the following claims.

I claim:

1. A foot support for insertion into a shoe, said foot support including a flexible top layer, a base layer, and a side wall, said side wall having upper and lower edges, the upper edge being connected to an edge region of said top layer and said lower edge being in abutting engagement with an edge region of said base layer a cavity being defined between said top and base layers and said side wall, and said cavity extending about a forward portion of said foot support, which portion is located substantially intermediate opposite portions of said side wall in a region of said foot support to underly the transverse arch of a foot, said cavity containing a flowable, highly viscous gel that can locally deform under pressure within the cavity and which facilitates the adaptation of said flexible top layer overlying said cavity to the sole of a foot for support thereof, access to said cavity being provided about the full extent of said side wall lower edge between said lower edge of said side wall and said edge region of said base layer by separating said base layer from said lower edge to facilitate addition or removal of said gel to/from said cavity, whereafter said base layer is returned to abutting engagement with said lower edge, said gel being of such a high viscosity, that leakage between said lower edge and said base layer is substantially eliminated.

2. A foot support according to claim 1, including a heel portion about which said cavity extends.

3. A foot support according to claim 2 wherein said top layer overlies said base layer in the region of said heel portion, said respective layers being connected together so as to separate said heel portion from said cavity.

4. A foot support according to claim 2 wherein said top and base layers are connected together by stitching.

5. A foot support according to claim 2 wherein said top and base layers are connected together by adhesive.

6. A foot support according to claim 2, said heel portion having a shape selected from the group consisting of a round, oval and tear drop shape.

7. A foot support according to claim 2 wherein said heel portion supports a heel of a foot by a support medium.

8. A foot support according to claim 7 wherein said support medium is a flowable gel of the kind contained in the cavity.

9. A foot support according to claim 2 wherein said heel portion is fully surrounded by said cavity.

10. A foot support according to claim 2 wherein said top layer extending from side portions of said heel portion is inclined upwardly toward said side wall to cup the heel of a foot.

11. A foot support according to claim 2, said side wall extending on both sides of said support and about the rear of the heel portion.

12. A foot support according to claim 1, including a heel portion about which said cavity extends, wherein said forward portion is a pocket which has an apex formed towards said heel portion with opposite sides diverging away from the apex toward a front of said foot support.

13. A foot support according to claim 12 wherein said cavity extends about said apex and adjacent both of said opposite sides.

14. A foot support according to claim 1, wherein said forward portion is a pocket which is open at a front of said foot support to enable insertion of a support medium therein.

15. A foot support according to claim 1, said forward portion is a pocket also being located in the region beneath the second, third and fourth matatarsals.

16. A foot support according to claim 1 wherein said forward portion is a pocket which is formed by a portion of said top layer overlying said bottom layer, said respective layers being connected together so as to separate said pocket from said cavity.

17. A foot support according to claim 16 wherein said top and base layers are connected together by stitching.

18. A foot support according to claim 16 wherein said top and base layers are connected together by adhesive.

19. A foot support according to claim 1 wherein said forward portion is a pocket for containing a support medium, said support medium being selected from the group consisting of foam, paper, cardboard, plastic or rubber.

20. A foot support according to claim 1 wherein a flowable gel is contained within a flexible package prior to insertion within said forward pocket.

21. A foot support according to claim 1 wherein said forward portion is a pocket for containing a support medium and wherein a volume of said support medium in said forward pocket is capable of being adjustable by the addition and removal of said support medium therefrom.

22. A foot support according to claim 1, said side wall being resiliently flexible.

23. A foot support according to claim 22, said side wall being constructed from ethyl vinyl acetate foam having a thickness of less than 10 mm.

24. A foot support according to claim 22, said side wall being constructed from a stiff leather.

25. A foot support according to claim 1 wherein the upper surface of the side wall is constructed to shape approximately to the lateral and medial arches of a foot.

26. A foot support according to claim 1 wherein an upper surface of said side wall is inclined downwardly from an outer edge thereof and said top layer is in fixed abutting connection with an inner surface of the side wall adjacent a lower inner edge of said side wall.

27. A foot support according to claim 1 wherein an upper surface of said side wall is inclined downwardly from an outer edge thereof and said top layer overlies said inclined upper surface in fixed engagement.

28. A foot support according to claim 1 wherein said top layer is fixed to said side wall by adhesive.

29. A foot support according to claim 1 wherein edge regions of said base layer are tucked up substantially perpendicular to the base layer into abutting engagement with the inner surface of said side wall, said edge regions being at least partially removable from said abutting engagement providing access to said cavity.

30. A foot support according to claim 1, said forward portion being arranged as a pocket which is able to receive a support medium to facilitate adjustable support of a transverse arch of a foot.

31. A foot support for insertion into a shoe, said foot support including a flexible top layer, a base layer, and a side wall connected to edge regions of said top and base layers, said foot support further including a cavity defined between said top and base layers, which extends about a forward portion of said support located substantially intermediate opposite portions of said side wall in a region of said foot support to underly the transverse arch of a foot, said cavity containing a flowable, highly viscous gel, said flowable gel facilitating the adaptation of said flexible top layer overlying said cavity to the sole of a foot for support thereof, wherein edge regions of said base layer are tucked up substantially perpendicular to the base layer into abutting engagement with the inner surface of said side wall, said edge regions being at least partially removable from said abutting engagement providing access to said cavity.

* * * * *

UNITED STATES PATENT AND TRADEMARK OFFICE

CERTIFICATE OF CORRECTION

PATENT NO. : 6,003,250
DATED : December 21, 1999
INVENTOR(S) : Wilson Cheong

It is certified that error appears in the above-identified patent and that said Letters Patent is hereby corrected as shown below:

Column 8, line 1, please delete "claim 2" and insert therefor -- claim 3 --.

Column 8, line 3, please delete "claim 2" and insert therefor -- claim 3 --.

Signed and Sealed this

Twenty-fifth Day of July, 2000

*Attest:*

*Attesting Officer*

Q. TODD DICKINSON

*Director of Patents and Trademarks*